US005124181A

United States Patent [19]

Schaffer et al.

[11] Patent Number: 5,124,181

[45] Date of Patent: Jun. 23, 1992

[54] COPOLYMERS BASED ON LONG-CHAIN UNSATURATED ESTERS AND ETHYLENICALLY UNSATURATED CARBOXYLIC ACIDS FOR MAKING LEATHER AND FURS WATER REPELLENT

[75] Inventors: Ortwin Schaffer, Ludwigshafen; Herbert Bay, Reutlingen; Karl Stork, Carlsberg; Norbert Greif, Bobenheim; Knut Oppenlaender, Ludwigshafen; Walter Denzinger, Speyer; Heinrich Hartmann, Limburgerhof, all of Fed. Rep. of Germany

[73] Assignee: BASF Aktiengesellschaft, Ludwigshafen, Fed. Rep. of Germany

[21] Appl. No.: 582,329

[22] Filed: Sep. 14, 1990

[30] Foreign Application Priority Data

Sep. 16, 1989 [DE] Fed. Rep. of Germany ..... 3931039

[51] Int. Cl.[5] ..... B05D 3/00; B05D 3/12

[52] U.S. Cl. ..... 427/323; 252/8.57; 427/389; 427/393.4; 525/183; 525/329.9

[58] Field of Search ..... 427/389, 323, 393.4; 252/8.57; 525/183, 329.9

[56] References Cited

U.S. PATENT DOCUMENTS

| | | | |
|---|---|---|---|
| 4,009,228 | 2/1977 | Tazuma et al. | 525/183 |
| 4,190,687 | 2/1980 | Sugiura et al. | 427/389 |
| 4,330,597 | 5/1982 | Heins et al. | 427/389 |
| 4,424,298 | 1/1984 | Penzel et al. | 524/747 |

FOREIGN PATENT DOCUMENTS

| | | |
|---|---|---|
| 3344354 | 6/1985 | Fed. Rep. of Germany . |
| 3817000 | 11/1989 | Fed. Rep. of Germany . |

*Primary Examiner*—Michael Lusignan

*Attorney, Agent, or Firm*—Oblon, Spivak, McClelland, Maier & Neustadt

[57] ABSTRACT

Copolymers which contain a) from 50 to 90% by weight of $C_8$–$C_{40}$-alkyl methacrylates, vinyl esters of $C_8$–$C_{40}$-carboxylic acids or mixtures thereof and b) from 10 to 50% by weight of monoethylenically unsaturated $C_3$–$C_{12}$-carboxylic acids, monoethylenically unsaturated dicarboxylic anhydrides, monoesters or monoamides of monoethylenically unsaturated $C_4$–$C_{12}$-dicarboxylic acids, amides of $C_3$–$C_{12}$-monocarboxylic acids or mixtures thereof as copolymerized units and have molecular masses of from 500 to 30,000 are used in at least partially neutralized form in aqueous solution or dispersion for making leather and furs water repellent.

9 Claims, No Drawings

COPOLYMERS BASED ON LONG-CHAIN UNSATURATED ESTERS AND ETHYLENICALLY UNSATURATED CARBOXYLIC ACIDS FOR MAKING LEATHER AND FURS WATER REPELLENT

DE-A 38 17 000 discloses fuels for Otto motors which contain, inter alia, small amounts of copolymers of a) $C_8$–$C_{40}$-alkyl acrylates, or the corresponding methacrylates, vinyl esters of $C_8$–$C_{40}$-carboxylic acids and
b) monoethylenically unsaturated carboxylic acids of 3 to 12 carbon atoms.

The copolymers have a molecular mass of from 500 to 20,000. At least some of the carboxyl groups in the copolymers are in the form of an alkali metal or alkaline earth metal salt. As also indicated therein, some of the carboxyl groups in the copolymers can also be amidated.

U.S. Pat. No. 4 190 687 discloses the treatment of dyed leather with copolymers of monoethylenically unsaturated carboxylic esters of 4 to 22 carbon atoms and aliphatic olefins of 3 to 20 carbon atoms. The copolymers are used for this in the form of a solution in an organic solvent. Suitable and preferred solvents are aromatic hydrocarbons, chlorohydrocarbons, ketones, ethers, esters and amides. However, solutions containing organic solvents cannot be used in practice for making leather and furs water repellent.

The use of aqueous polyacrylate dispersions in which the copolymer is predominantly composed of acrylic or methacrylic esters of alcohols of 1 to 8 carbon atoms for finishing leather is disclosed in DE-A 33 44 354 and EP-B 0 065 253. However, emulsifiers are always needed to prepare the aqueous polymer dispersions.

It is an object of the present invention to provide emulsifier-free water repellents for leather and furs.

We have found that this object is achieved by using copolymers which contain a) from 50 to 90% by weight of $C_8$–$C_{40}$-alkyl acrylates, $C_8$–$C_{40}$-alkyl methacrylates, vinyl esters of $C_8$–$C_{40}$-carboxylic acids or mixtures thereof and
b) from 10 to 50% by weight of monoethylenically unsaturated $C_3$–$C_{12}$-carboxylic acids, monoethylenically unsaturated dicarboxylic anhydrides, monoesters or monoamides of monoethylenically unsaturated $C_4$–$C_{12}$-dicarboxylic acids, amides of monoethylenically unsaturated $C_3$–$C_{12}$-carboxylic acids or mixtures thereof as copolymerized units, and which have molecular masses of from 500 to 30,000, in at least partially neutralized or amidated form in aqueous solution or dispersion, as water repellents for leather and furs.

The copolymers are disclosed, for example, in DE-A 38 17 000. They are prepared by copolymerizing the group a) monomers with the group b) monomers. If monoethylenically unsaturated dicarboxylic anhydrides are employed as group b) monomers, and the copolymerization is carried out with exclusion of water, the copolymerization is followed by solvolysis of the anhydride moieties in the copolymer. This can take place at the same time as a partial or complete neutralization of the carboxyl groups, by treating the copolymers with bases. Partial amidation of the copolymers is also possible if ammonia or primary or secondary amines are used as bases. Suitable group a) monomers for preparing the copolymers are $C_8$–$C_4$-alkyl acrylates and $C_8$–$C_{40}$-alkyl methacrylates. Examples of suitable compounds of this type are 2-ethylhexyl acrylate, 2-ethylhexyl methacrylate, n-decyl acrylate, n-decyl methacrylate, dodecyl acrylate, dodecyly methacrylate, isotridecyl acrylate, isotridecyl methacrylate, tetradecyl acrylate, tetradecyl methacrylate, $C_{16}$/$C_{18}$-tallow fatty alcohol acrylate, $C_{16}$/$C_{18}$-tallow fatty alcohol methacrylate, octadecyl acrylate, octadecyl methacrylate, palmityl acrylate, palmityl methacrylate, n-eicosyl acrylate, n-eicosyl methacrylate, n-docosyl acrylate, n-docosyl methacrylate, tetracosyl acrylate, tetracosyl methacrylate, hexacosyl acrylate, hexacosyl methacrylate, octocosyl acrylate, octocosyl methacrylate and acrylic and methacrylic esters of $C_{40}$-alcohols. Also suitable are mixtures of acrylates, which can be prepared by, for example, esterifying alcohols which can be obtained either by the oxo process or by the Ziegler process. Preferably used are the acrylic and methacrylic esters derived from alcohols of 16 to 28 carbon atoms.

Also suitable as component a) are vinyl esters of carboxylic acids of from 8 to 40 carbon atoms. Examples of such compounds are vinyl 2-ethylhexanoate, vinyl laurate, vinyl palmitate, vinyl tallow fatty acid esters, vinyl myristate, vinyl stearate, vinyl oleate and mixtures of the said vinyl esters or mixtures of at least one vinyl ester with at least one of the suitable alkyl (meth)acrylates. Group a) monomers are present as copolymerized units in amounts of from 50 to 90, preferably 65 to 85,% by weight in the copolymers.

The group b) monomers include monoethylenically unsaturated $C_3$–$C_{12}$-carboxylic acids and monoethylenically unsaturated dicarboxylic anhydrides. Examples of suitable monoethylenically unsaturated carboxylic acids are acrylic, methacrylic, crotonic, vinyllactic, allylacetic, propylideneacetic, ethylacrylic, dimethylacrylic, maleic, fumaric, itaconic, glutaconic, methylenemalonic, citraconic and tetrahydrophthalic acids. Examples of ethylenically unsaturated dicarboxylic anhydrides which contain a total of from 4 to 12 carbon atoms per molecule are maleic, itaconic, citraconic, methylenemalonic and tetrahydrophthalic anhydrides. Also suitable as group b) monomers are monoesters of dicarboxylic acids with alcohols of 1 to 40 carbon atoms, for example monomethyl maleate, monobutyl maleate, monododecyl maleate, monooctadecyl maleate, monotetracosyl maleate, monooctadecyl fumarate, monooctadecyl itaconate, mono-2-ethylhexyl itaconate and mixtures of the said compounds. Preferred group b) monomers are acrylic, methacrylic and maleic acids, maleic anhydride, itaconic acid and itaconic anhydride.

The group b) monomers also include amides of the monoethylenically unsaturated monocarboxylic acids and the monoamides of monoethylenically unsaturated dicarboxylic acids, e.g. amides and monoamides derived from the relevant carboxylic acids and ammonia or amines of 1 to 40 carbon atoms, for example N-isotridecylacrylamide, N,N-diisotridecylacrylamide, N-stearylacrylamide, N-stearylmethacrylamide, N-isotridecylmaleamic acid, N,N-diisotridecylmaleamic acid, N-stearylmaleamic acid and N,N-distearylmaleamic acid.

The copolymers contain the group b) monomers in amounts of from 10 to 50, preferably 15 to 35,% by weight as copolymerized units.

The copolymers of the group a) and b) monomers can also be modified by copolymerization in the presence of group c monomers. Examples of group c) monomers are styrene, methylstyrene, ethylstyrene, butylstyrene, N-vinylpyrrolidone, N-vinylcaprolactam, N-vinylformamide, N-vinyl-N-methylformamide, N-vinylacetamide, N-vinyl-N-methylacetamide, methyl acrylate, ethyl acrylate, propyl acrylate, butyl acrylate, hexyl acrylate, methyl methacrylate, ethyl methacrylate, propyl methacrylate, butyl methacrylate, hexyl methacrylate, hydroxyethyl acrylate, hydroxypropyl acrylate, hydroxybutyl acrylate, hydroxyethyl methacrylate, hydroxypropyl acrylate, hydroxybutyl acrylate, monomethyl maleate, dimethyl maleate, dimethyl maleate, monoethyl maleate, diethyl maleate, monopropyl maleate, dipropyl maleate, monobutyl maleate, dibutyl maleate, monohexyl maleate, dihexyl maleate, monomethyl fumarate, dimethyl fumarate, monoethyl fumarate, diethyl fumarate, monopropyl fumarate, dipropyl fumarate, monobutyl fumarate, dibutyl fumarate, monohexyl fumarate, dihexyl fumarate, vinyl formate, vinyl acetate, vinyl propionate, vinyl butyrate, acrylonitrile, methacrylonitrile, dimethylaminoethyl acrylate, diethylaminoethyl acrylate, dimethylaminoethyl methacrylate, diethylaminoethyl methacrylate, dimethylaminopropyl acrylate, diethylaminopropyl acrylate, dimethylaminopropyl methacrylate, diethylaminopropyl methacrylate, dimethylaminopropylacrylamide, 1-vinylimidazole, 1-vinyl-2-methylimidazole, 1-vinyl-4-methylimidazole, 1-vinyl-5-methylimidazole, vinylsulfonic acid, allylsulfonic acid, methallylsulfonic acid, acrylamidomethylpropanesulfonic acid, styrenesulfonic acid, 3-sulfopropyl acrylate, vinylphosphonic acid, allylphosphonic acid and mixtures thereof.

When group c) monomers are used for modifying the copolymers of a) and b) they are present as copolymerized units in the latter in amounts of from 1 to 20% by weight.

The copolymerization of the group a) and b), and c) where appropriate, monomers is carried out by any of the known batchwise or continuous processes such as bulk, suspension, precipitation and solution polymerization. The copolymerization is preferably carried out in the presence of compounds which form free radicals. Up to 10, preferably from 0.2 to 5,% by weight thereof, based on the monomers employed in the copolymerization, are required. All the said polymerization processes are carried out with exclusion of oxygen, preferably under a stream of nitrogen. Conventional equipment is used for all the polymerization methods, e.g. autoclaves and vessels equipped, for example, with anchor, paddle, impeller or multistage pulse countercurrent agitators. Bulk polymerization of group a) and b) monomers is particularly preferred. It is carried out at from 80 to 300, preferably 120° to 200° C., where the lowest temperature to be chosen for the polymerization is preferably not less than about 20° C. above the glass temperature of the polymer formed. The chosen polymerization conditions depend on the molecular weight which the copolymers are to have. Polymerization at high temperatures yields copolymers of low molecular weights, while lower temperature polymerization produces polymers of higher molecular weights. The amount of initiator also has an influence on the molecular weight. In general, from 0.01 to 5% by weight, based on the monomers employed in the polymerization, of initiators which form free radicals are required. Larger amounts produce copolymers of lower molecular weights. Monomers a) and b) can also be copolymerized in the absence of initiators at temperatures above 200° C., i.e. initiators are not absolutely necessary because monomers a) and b) undergo free radical polymerization above 200° C. even in the absence of initiators.

Examples of suitable initiators are acetyl cyclohexanesulfonyl peroxide, diacetyl peroxydicarbonate, dicyclohexyl peroxydicarbonate, di-2-ethylhexyl peroxydicarbonate, tert-butyl perneodecanoate, 2,2'-azobis(4-methoxy-2,4-dimethylvaleronitrile), tert-butyl perpivalate, tert-butyl per-2-ethylhexanoate, tert-butyl permaleate, 2,2'-azobis(isobutyronitrile), bis(tert-butylperoxy)cyclohexane, tert-butylperoxy isopropyl carbonate, tert-butyl peracetate, di-tert-butyl peroxide, di-tert-amyl peroxide, cumene hydroperoxide and tert-butyl hydroperoxide. The initiators can be used alone or mixed with one another. In the case of bulk polymerization, they are preferably introduced into the polymerization reactor separately or in the form of a solution or dispersion in the component a) monomer. It is, of course, also possible to use redox coinitiators for the copolymerization, e.g. benzoin, dimethylaniline, ascorbic acid and heavy metal complexes which are soluble in organic solvents, such as those of copper, cobalt, iron, manganese, nickel and chromium. The use of redox coinitiators allows the polymerization to be carried out at lower temperatures. The amounts of redox coinitiators normally used are from 0.1 to 2,000, preferably 0.1 to 1,000, ppm based on the amounts of monomers employed. If the monomer mixture is initially polymerized at the lower limit of the temperature range suitable for the polymerization, and then polymerization is completed at a higher temperature, it is expedient to use at least two initiators which decompose at different temperatures so that an adequate concentration of free radicals is available at each temperature.

For the preparation of low molecular weight polymers it is often expedient to carry out the copolymerization in the presence of regulators. Conventional regulators can be used for this purpose, such as $C_1$–$C_4$-aldehydes, allyl alcohol, 1-buten-3-ol, formic acid and organic compounds containing SH groups, such as 2-mercaptoethanol, 2-mercaptopropanol, mercaptoacetic acid, mercaptopropionic acid, tert-butyl mercaptan, n-dodecyl mercaptan and tert-dodecyl mercaptan. The polymerization regulators are generally employed in amounts of from 0.1 to 10% by weight based on the monomers.

It is particularly advantageous to use for bulk polymerization a pressure vessel with a downstream reaction tube which is provided with a static mixer. The monomers, comprising the (meth)acrylates, vinyl esters and monoethylenically unsaturated compounds containing acid groups, are preferably polymerized in not less than 2 zones arranged in series. It is possible for these reaction zones to comprise, on the one hand, a pressure-tight vessel and, on the other hand, a static mixer which can be heated. Conversions exceeding 99% are achieved in this way. A copolymer of stearyl acrylate and acrylic acid can be prepared, for example, by continuously feeding the monomers and a suitable initiator into a reactor or 2 reaction zones in series, for example a cascade of stirred vessels, and removing the reaction product continuously from the reaction zone after a holdup time of from 2 to 60, preferably from 5 to 30, minutes at from 200° to 400° C. The polymerization is expediently carried out under pressures exceeding 1 bar, preferably under from 1 to 200 bar. The resulting copolymers with solids contents exceeding 99% can then be reacted further to give the corresponding alkali metal and alkaline earth metal salts or amides and ammonium salts.

Another preferred procedure for preparing the copolymers is solution polymerization which is carried out in solvents in which the monomers and the copolymers are soluble. Solvents suitable for this purpose are all those which meet this requirement and do not react with the monomers. Examples are acetone, methyl ethyl ketone, diethyl ketone, methyl isobutyl ketone, ethyl acetate, butyl acetate, aliphatic, cycloaliphatic and aromatic hydrocarbons such as n-octane, isooctane, cyclohexane, methylcyclohexane, benzene, toluene, xylene, ethylbenzene, cumene, tetrahydrofuran and dioxane, those which are particularly suitable for obtaining low molecular weight copolymers being xylene, ethylbenzene, cumene, tetrahydrofuran and dioxane. It is also expedient in this case, as it is in bulk and precipitation polymerization, to introduce the solvent and part of the monomer mixture (e.g. about 5 to 20%) first and then to meter in the remainder of the monomer mixture with the initiator and, where appropriate, coinitiator and regulator. It is also possible to introduce the solvent and (meth)acrylate or vinyl ester into the polymerization reactor first and then, after the polymerization temperature has been reached, to meter in the monomer containing acid groups, which may be dissolved in the solvent, and the initiator plus, where appropriate, coinitiator and regulator. The concentrations of the monomers are from 20 to 80% by weight, preferably 30 to 70% by weight. The solid copolymer can be isolated easily by evaporating the solvent.

Another straightforward method for preparing the copolymers is precipitation polymerization. The solvents used for this are those in which the monomers are soluble and the copolymer is insoluble and precipitates. Examples of such solvents are ethers such as diethyl ether, dipropyl ether, dibutyl ether, methyl tert-butyl ether, diethylene glycol dimethyl ether and mixtures thereof. It is expedient to carry out the precipitation polymerization, especially when the concentration exceeds 40% by weight, in the presence of a protective colloid to prevent aggregate formation. Suitable protective colloids are polymers which are readily soluble in the solvents and do not react with the monomers. Suitable examples are copolymers of maleic anhydride with vinyl alkyl ethers and/or olefins of 8 to 20 carbon atoms, as well as corresponding copolymers of monoesters of maleic acid with $C_{10}$–$C_{20}$-alcohols or of mono- and diamides of maleic acid with $C_{10}$–$C_{20}$-alkylamines as well as polyvinyl alkyl ethers whose alkyl group contains from 1 to 20 carbon atoms, such as polyvinyl methyl, ethyl, isobutyl and octadecyl ethers. The amounts of protective colloid added are normally from 0.05 to 4% by weight (based on monomers employed), preferably from 0.1 to 2% by weight, and it is often advantageous to combine several protective colloids. The polymerization is expediently carried out in such a way that the solvent, the protective colloid and a part of the monomer mixture are introduced into the reactor first and then, at the selected polymerization temperature and while stirring vigorously, the remainder of the monomer mixture and the initiator and, where appropriate, the coinitiator and regulator are metered in. The monomer and initiator are generally added over from 1 to 10 h, preferably 2 to 5 h. It is also possible to introduce all the starting materials together into a reactor for the polymerization, but this may give rise to problems with the dissipation of heat so that such a procedure is less expedient. The monomer concentrations are from 20 to 80% by weight, preferably 30 to 70% by weight. The polymers can be isolated from the suspensions thereof by, for example, evaporating off the suspending agent in, for example, belt driers, trough driers, spray driers and fluidized bed driers.

The group a) and b) and, where appropriate, c) monomers are copolymerized by the processes described above so that copolymers with molecular masses of from 500 to 30,000, preferably 1,000 to 20,000, are obtained. Copolymers which are preferred for the use according to the invention are composed of stearyl acrylate and maleic anhydride or acid, of $C_{18}$–$C_{22}$-alkyl methacrylates and acrylic acid or methacrylic acid, of octadecyl acrylate and acrylic acid, maleic acid or anhydride, and of vinyl 2-ethylhexanote or vinyl stearate and maleic anhydride. The copolymers of the long-chain vinyl esters and maleic anhydride preferably contain the monomers as copolymerized units in the molar ratio of 1:1.

To prepare aqueous solutions or dispersions ready for use from the copolymers produced in the processes described above, firstly volatiles are substantially removed from the copolymers by, preferably, heating them to a maximum of 150° C. under reduced pressure. Volatiles distil out under these conditions. It is possible in this way, for example, to remove a low-boiling regulator from copolymers prepared by bulk polymerization. In the case of polymers obtained by solution polymerization it is advantageous to remove the solvent used in the polymerization by distillation before preparing aqueous solutions. However, anhydride moieties in the copolymers can be converted into monoamides in the solution in the organic solvent by reacting them with ammonia or amines. The reaction of copolymers containing anhydride moieties with alcohols, ammonia or amines is preferably carried out in the absence of solvents.

The copolymers obtained by the processes described above are dissolved or dispersed in water and at least partially neutralized. However, where monoethylenically unsaturated carboxylic acids or dicarboxylic anhydrides have been used as group b) monomers, the resulting copolymers can be converted into the corresponding amides or monoamides. This is carried out, for example, by adding ammonia or primary and/or secondary amines to a melt of the copolymers from which the volatiles have been removed. This reaction is carried on in such a way that from 20 to 50% of the carboxyl groups in the carboxylic acids or from the hydrolysis of the dicarboxylic anhydrides forming copolymerized units have been amidated and not less than 10% of the total of carboxyl groups in the copolymer have been neutralized. Solutions ready for use for making leather and furs water repellent are obtained by the copolymers, after they have been cooled to room temperature or, preferably, in the form of a melt at from 80 to 180, preferably 90° to 150° C., being neutralized or partially amidated, as described above, by adding ammonia or primary and/or secondary amines. The amounts of water and neutralizing agents are chosen so that the dispersions or solutions which are marketed contain from 10 to 60, preferably 20 to 55,% by weight of solids. Solutions containing from 0.5 to 50% by weight of solids are then prepared from these by dilution with water.

It is also possible to use amino carboxylic acids and salts thereof, preferably the alkali metal salts, for solvolysis. Alkali metal salts of α-amino carboxylic acids are particularly preferably employed, with the alkali metal salts of sarcosine being very particularly advantageous. Solvolysis with salts of amino carboxylic acids is expediently carried out in aqueous medium. The amounts of amino carboxylates used for the solvolysis are such that from 20 to 50% of the carboxyl groups in the carboxylic acids or from the hydrolysis of the dicarboxylic anhydrides forming copolymerized units are amidated. The formation of monoamide moieties in the copolymer is followed by neutralization in such a way that not less than 10% of the carboxyl groups in the copolymer from the bulk polymerization are neutralized.

The copolymers containing acid or anhydride moieties can also be esterified by reaction with alcohols in such a way that from 10 to 50% of the acid moieties are esterified. This is followed by neutralization of the partially esterified copolymers so that not less than 10% of the carboxyl groups are neutralized. The neutralization of the copolymers containing anhydride or acid groups is effected at least to such a degree that the resulting copolymers are dispersible in water. This degree of neutralization corresponds to at least 10% of the carboxyl groups of the copolymer or at least 10% of the total of carboxyl groups formed from the anhydride groups of the copolymer. The degree of neutralization also depends on the chain length of the alkyl acrylate or methacrylate or of the vinyl esters used. In order to obtain copolymers which readily form dispersions or colloidal solutions in water, for example a copolymer of a $C_{30}$-alkyl acrylate and maleic acid will be not less than 75% neutralized whereas, for example, a copolymer of a $C_{20}$-alkyl acrylate and maleic anhydride will be readily dispersible in water with only 50% of the carboxyl groups neutralized. Neutralization of only 20% of the carboxyl groups produced from the maleic anhydride forming copolymerized units in a copolymer of a $C_{12}$-alkyl acrylate or methacrylate and maleic anhydride or acid suffices for the copolymer to be dispersible in water.

If a monoamide has not been used as group b) monomer and the copolymer is required to have monoamide moieties, it is possible to react copolymers which contain a carboxylic acid or, preferably, dicarboxylic anhydride as group b) monomer forming copolymerized units with ammonia or primary and/or secondary amines in the absence of water to give the corresponding monoamides. Suitable primary and secondary amines can have from 1 to 40, preferably 3 to 30, carbon atoms. Examples are methylamine, ethylamine, n-propylamine, isopropylamine n-butylamine, isobutylamine, hexylamine, cyclohexylamine, methylcyclohexylamine, 2-ethylhexylamine, n-octylamine, isotridecylamine, tallow fatty amine, stearylamine, oleylamine, dimethylamine, diethylamine, di-n-propylamine, diisopropylamine, di-n-butylamine, diisobutylamine, dihexylamine, dicyclohexylamine, dimethylcyclohexylamine, di-2-ethylhexylamine, di-n-octylamine, diisotridecylamine, di-tallow fatty amine, distearylamine, dioleylamine, ethanolamine, diethanolamine, n-propanolamine, di-n-propanolamine and morpholine. Morpholine is preferably used.

The copolymers can be neutralized with the amines indicated above or with ammonia or alkali metal and/or alkaline earth metal bases, e.g. sodium or potassium hydroxide, sodium carbonate or bicarbonate, potassium carbonate, or magnesium, calcium or barium hydroxide. Solutions or dispersions ready for use are preferably prepared by adding an aqueous base to a melt of the copolymer. The pH of the water repellent ready for use is from 4 to 10. Of course, it is also possible to prepare the aqueous solution or dispersion by adding the copolymer to an aqueous solution of the alkali metal and/or alkaline earth metal base, preferably at from 20° to 150° C.

The aqueous copolymer dispersions or solutions obtained in this way are stable on storage. They are outstandingly suitable for finishing leather and furs because they have a particularly pronounced water-repellent action and, furthermore, display a greasing and retanning action. The leather or fur material treated with these copolymer dispersions is permeable to and absorbs water to only a small extent. At the same time, the dispersions have a softening effect so that, in most cases, no additional fatliquoring with natural or synthetic oils is necessary. The dispersions impart to the goods a high degree of fullness and high tensile strength and resistance to tearing so that additional treatment with commercial retanning agents, for example vegetable tanning agents or synthetic organic tanning agents based on phenolsulfonic acid/phenol/formaldehyde condensation products is unnecessary in most cases.

Another advantage of the aqueous dispersions or solutions to be used according to the invention comprises the absence of additional emulsifiers therefrom. As is known, leather and furs which have been treated with emulsifier-containing products must subsequently be subjected to elaborate processes, such as treatment with multivalent metal salts, in order to inactivate the emulsifiers in the leather or furs.

The copolymer dispersions or solutions described above are suitable for treating all conventional tanned hides, especially hides tanned with mineral tanning agents such as chromium(III) salts. The tanned hides are normally neutralized, and may have been dyed, before the treatment. However, dyeing can also take place after the water-repellent treatment according to the invention.

The tanned hides are expediently treated in an aqueous liquor which has been obtained by diluting the copolymer dispersions or solutions with water at a pH of from 4 to 10, preferably 5 to 8, and at from 20 to 60, preferably 30° to 50° C., for from 0.1 to 5, in particular 0.5 to 2 hours. This treatment is carried out, for example, by drumming. The amount of copolymer dispersion or solution required is from 0.1 to 30, preferably 1 to 20%, by weight based on the shaved weight of the leather or the wet weight of the furs. The liquor ratio, i.e. the ratio of the weight of the treatment liquor to the shaved weight of the leather or the wet weight of the furs, is normally from 10 to 1,000, preferably 30 to 150%, in the case of furs from 50 to 500%.

After the treatment with the aqueous liquor described above, the pH of the liquor is adjusted to from 3 to 5, preferably 3.5 to 4, by addition of acids, preferably organic acids such as formic acid.

When conventional retanning agents are also used in the finishing of the leather and furs, the treatment with the aqueous dispersions or solutions according to the invention can take place before or after the retanning or even in several stages, using portions of the aqueous dispersions or solutions before, during and after the retanning. The aqueous dispersions or solutions to be used as water repellents can also be used together with conventional finishing agents for leather and furs, such as paraffin-based fatliquors. In some cases, this improves the water-repellent, fatliquoring and retanning action.

In the examples, percentages are by weight unless stated otherwise. The molecular masses of the copolymers were determined by gel permeation chromatography before the neutralization, using tetrahydrofuran as eluent and calibrating with a narrow range of polystyrene fractions. The treated leather was tested for permeability to and absorption of water by the IUP 10 method of the International Union of Leather Chemists' Associations, Commission on the physical testing of leather, cf. Das Leder, 12 (1961) 36–40, using a Bally penetrometer.

Preparation of the aqueous copolymer dispersions

Dispersion I 90 g of maleic anhydride and 100 g of technical xylene were introduced into a stainless steel reactor equipped with a stirrer, charging devices and a device for working under nitrogen, and were heated to boiling at about 140° C. To the gently boiling solution were added simultaneously a warmed solution of 210 g of stearyl acrylate, 4.5 g of 1-buten-3-ol and 15 g of 2-mercaptoethanol in 200 g of technical xylene within 2 h, and a solution of 9 g of di-tert-butyl peroxide in 31 g of technical xylene within 3 h. The stirred reaction mixture was then refluxed for 2 h and subsequently the xylene was distilled out, removing residual xylene under 40 millibars at 125° C. Then 79.9 g of morpholine were added within half an hour, and the stirred reaction mixture was heated at 130° C. for 2 h. This converted all the anhydride moieties in the copolymer into monoamide moieties. The reactor was then closed pressure-tight and, with the polymer melt at 125° C., 73.5 g of 50% strength aqueous sodium hydroxide solution and 1130 g of water were added within 1 h. This neutralized the remaining carboxyl groups in the copolymer. The reaction mixture was then stirred at 125° C. for 2 h and cooled to room temperature. The resulting dispersion was slightly viscous at room temperature and had a solids content of 25.8%. The molecular mass of the copolymer was 6400.

Dispersion II 281.25 g of an 80% strength solution of a $C_{18}$–$C_{22}$-alkyl methacrylate (methacrylic ester of a $C_{18}$–$C_{22}$-alcohol mixture obtainable commercially under the name Alfol 1822) in o-xylene, 9 g of 1-buten-3-ol and 15 g of 2-mercaptoethanol were introduced into the reactor described for preparing dispersion I, and the solution was heated to boiling at about 145° C. To the refluxing solution were then added at a constant rate a solution of 75 g of acrylic acid in 15 g of o-xylene within 2 h and a solution of 9 g of di-tert-butyl peroxide in 31 g of o-xylene within 3 h. The stirred reaction mixture was then refluxed for 2 h, after which the o-xylene was distilled out, removing residual xylene from the polymer melt at 140° C. under 40 mbar. The polymer melt was then cooled to 125° C., and the reactor was closed pressure-tight and a solution of 78 g of 50% strength aqueous sodium hydroxide solution in 586 g of water was added within half an hour. This neutralized 95% of the carboxyl groups present in the copolymer. The reaction mixture was then stirred vigorously at 125° C. for 3 h. The resulting viscous dispersion had a solids content of 34.9%. The molecular mass of the copolymer was 4500.

Dispersion III 50 g of 1-buten-3-ol and 50 g of octadecyl acrylate were introduced into the reactor described for preparing dispersion I, and the mixture was stirred while heating to 110° C. Three separate charging devices were used to add at a constant rate 300 g of octadecyl acrylate which had been heated to 70° C., 150 g of methacrylic acid, each within 5 h, and 15 g of tert-butyl perethylhexanoate within 6 h. The polymerization was carried out at the boiling point of the mixture, which slowly rose to 132° C. After the addition of the peroxide was complete, the stirred reaction mixture was refluxed for 1 h. The unreacted 1-buten-3-ol was then removed by distillation under 40 mbar at 125° C. The reactor was then closed pressure-tight and the melt therein was heated to 140° C. and, under pressure, 125 g of 50% strength aqueous sodium hydroxide solution and 1173 g of water were added within 1 h. The mixture was then stirred at 120° C. for 1 h. The resulting emulsion was viscous at room temperature and had a solids content of 30.6%. The molecular mass of the copolymer was 3600. 90% of the carboxyl groups in the copolymer were in the form of the sodium salt.

EXAMPLE 1

Chrome-tanned side leather which had a shaved thickness of 1 8 mm, had been neutralized to a pH of 5.0 and dyed with 0.7% by weight of a commercial anionic aniline dye was drummed with 20% of dispersion I, based on shaved weight, at 40° C. for one and a half hours. After this treatment, the leather was adjusted to pH 3.6 with formic acid and then washed, mechanically set out and dried.

The resulting leather was very soft and pliable and had a high dynamic water resistance. Testing with a Bally penetrometer at a compression of 15% showed a water uptake of 24.7% by weight after 24 h and no evident penetration by water during this time.

EXAMPLE 2

Chrome-tanned side leather which had a shaved thickness of 1.8 mm and had been neutralized to a pH of 5.0 was drummed with 12% of dispersion II, based on shaved weight, at 40° C. for 2 hours. The total liquor ratio was 150%.

The leather was then dyed with 1% by weight of a conventional anionic aniline dye, after which it was adjusted to pH 3.8 with formic acid. It was subsequently washed, mechanically set out and dried.

The resulting leather was very soft, supple, well filled, uniformly dyed and had an excellent dynamic water resistance. Testing with a Bally penetrometer at a compression of 15% showed a water uptake of 22.9% by weight after 24 h and no evident penetration of water during this time.

EXAMPLE 3

Chrome-tanned side leather which had a shaved thickness of 1.8 mm and had been neutralized to pH 5.0 was drummed with 15% of polymer dispersion III and, at the same time, with 5% of a 42% strength aqueous dispersion of a commercial paraffin-based fatliquor, in each case based on the shaved weight of the leather, for 2 h at 40° C. The total liquor ratio was 150%. Following this treatment, the leather was adjusted to pH 3.8 with formic acid and finished in a conventional manner.

The resulting leather was extremely soft and had a pleasant feel and high water resistance. Testing with a Bally penetrometer at 15% compression showed a water uptake of 19.5% by weight after 24 h and no evident penetration by water during this time.

We claim:

1. A process for making leather and furs water repellent, which comprises treating said leather and furs with copolymers which contain a) from 50 to 90% by weight of $C_8$–$C_{40}$-alkyl acrylates, $C_8$–$C_{40}$-alkyl methacrylates, vinyl esters of $C_8$–$C_{40}$-carboxylic acids or mixtures thereof and b) from 10 to 50% by weight of monoethylenically unsaturated $C_3$–$C_{12}$-carboxylic acids, monoethylenically unsaturated dicarboxylic anhydrides, monoesters or monoamides of monoethylenically unsaturated $C_4$–$C_{12}$-dicarboxylic acids, amides of monoethylenically unsaturated $C_3$–$C_{12}$-carboxylic acids or mixtures thereof as copolymerized units, and which have molecular masses of from 500 to 30,000, in at least partially neutralized form in aqueous solution or dispersion, as the water repellents.

2. A process as claimed by claim 1, wherein the copolymers are obtained by bulk polymerization of monomers a) and b) at from 80° to 300° C. and wherein the resulting copolymer melt is at least partially neutralized.

3. A process as claimed in claim 1, wherein water and ammonia, amines, alkali metal or alkaline earth metal bases are added to a melt of the copolymers of a) and b) in amounts such that no less than 10% of the carboxyl groups in the copolymers are neutralized.

4. A process as claimed in claim 1, wherein primary and/or secondary amines are added to a melt or a virtually anhydrous solution of the copolymers of a) and b) in an inert organic solvent so that from 20 to 50% of the carboxyl groups in the copolymerized monoethylenically unsaturated carboxylic acids or from 20 to 50% of the carboxyl groups obtainable by hydrolysis from the copolymerized monoethylenically unsaturated dicarboxylic anhydrides have been amidated and not less than 10% of the total of carboxyl groups in the copolymer have been neutralized.

5. A process as claimed in claim 1, wherein the copolymers are solvolyzed in aqueous medium by adding salts of amino carboxylic acids in amounts such that from 20 to 50% of the carboxyl groups in the copolymerized monoethylenically unsaturated carboxylic acids or from 20 to 50% of the carboxyl groups obtainable by hydrolysis from the copolymerized monoethylenically unsaturated dicarboxylic anhydrides are amidated, and subsequently neutralized so that not less than 10% of the total carboxyl groups present in the copolymer are neutralized.

6. A process for making leather and furs water repellent, which comprises treating said leather and furs with copolymers which contain a) from 50 to 90% by weight of $C_8$–$C_{40}$-alkyl acrylates, $C_8$–$C_{40}$-alkyl methacrylates, vinyl esters of $C_8$–$C_{40}$-carboxylic acids or mixtures thereof and b) from 10 to 50% by weight of monoethylenically unsaturated $C_3$–$C_{12}$-carboxylic acids, monoethylenically unsaturated dicarboxylic anhydrides, monoesters or monoamides of monoethylenically unsaturated $C_4$–$C_{12}$-dicarboxylic acids, amides of monoethylenically unsaturated $C_3$–$C_{12}$-carboxylic acids or mixtures thereof, as copolymerized units, and which have molecular masses of from 500 to 30,000 wherein water and ammonia, amines, alkali metal or alkylene earth metals bases are added to an melt of copolymers of a) and b) in amounts such that no less than 10% of the carboxylic groups in the copolymers are neutralized.

7. A process for making tanned leather water repellent which comprises a) neutralizing said leather to pH 5.0, b) drumming said neutralized leather is treated with 0.1 to 30% by weight based on the weight of the leather of a copolymer dispersion comprising copolymers which contain a) from 50 to 90% by weight of $C_8$–$C_{40}$-alkylacrylates, $C_8$–$C_{40}$-alkyl methacrylates, vinyl esters of $C_8$–$C_{40}$-carboxylic acids or mixtures thereof and b) from 10 to 50% by weight of monoethylenically unsaturated $C_3$–$C_{12}$-carboxylic acids, monoethylenically unsaturated dicarboxylic anhydrides, monoesters or monoamides of monoethylenically unsaturated $C_4$–$C_{12}$-dicarboxylic acids, amides of monoethylenically unsaturated $C_3$–$C_{12}$-carboxylic acids or mixtures thereof as copolymerized units, and which have molecular masses of from 500 to 30,000, wherein water and ammonia, amines, alkali metal or alkylene earth metals bases are added to an melt of the copolymers of a) and b) in amounts such that 10 to 95% of the carboxylic groups in the copolymers are neutralized, wherein said drumming is carried out at a temperature of at least 40° C. for a duration sufficient to impart water repellency to said tanned leather.

8. A process as claimed in claim 7, wherein said dispersion is in a range of 12–20% by weight based on the weight of the leather.

9. A process as claimed in claim 1, wherein said polymer is partially amidated.

* * * * *